US006442340B1

(12) United States Patent
Shimizu

(10) Patent No.: US 6,442,340 B1
(45) Date of Patent: Aug. 27, 2002

(54) HAIR PROCESSING ACCELERATOR WITH ROTATABLY ADJUSTABLE SEMICIRCULAR HEATERS

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/968,478

(22) Filed: Oct. 1, 2001

(30) Foreign Application Priority Data

Oct. 25, 2000 (JP) ..... 2000-325176

(51) Int. Cl.[7] ..... A45D 20/00

(52) U.S. Cl. ..... 392/414; 392/413; 392/415; 34/96; 34/266; D28/14; D28/17

(58) Field of Search ..... 392/412–415, 392/431; 34/266, 96–97; 607/96, 100, 109–110, 88, 90–91; 362/11, 216, 238–239, 250, 427–428; D28/14, 16–18; D26/102, 69–70, 80, 61

(56) References Cited

U.S. PATENT DOCUMENTS

| | | | | | |
|---|---|---|---|---|---|
| 1,667,775 | A | * | 5/1928 | Edmands | 392/413 |
| 1,672,597 | A | * | 6/1928 | Bhosys | 362/238 |
| 1,702,028 | A | * | 2/1929 | Blanchard | 392/412 |
| 4,528,618 | A | * | 7/1985 | Bitsch | 362/33 |
| 4,541,442 | A | * | 9/1985 | Hollmann et al. | 392/413 |
| 4,691,451 | A | * | 9/1987 | Giorgis | 34/68 |
| 4,910,382 | A | * | 3/1990 | Kakuya et al. | 392/423 |
| 4,914,273 | A | * | 4/1990 | Matsui | 34/97 |
| D321,411 | S | * | 11/1991 | Moll | D28/17 |
| 5,063,688 | A | * | 11/1991 | Moll et al. | 34/97 |
| 5,231,770 | A | * | 8/1993 | Fertig | 34/266 |
| D357,993 | S | * | 5/1995 | Yuen | D26/65 |

FOREIGN PATENT DOCUMENTS

| | | | |
|---|---|---|---|
| EP | 93824 | * 11/1983 | 392/413 |
| JP | 62-129009 | 6/1987 | |
| JP | 1-136603 | 5/1989 | |
| JP | 4-644 | 1/1992 | |
| JP | 7-32729 | 4/1995 | |
| JP | 10-113218 | * 5/1998 | |

* cited by examiner

*Primary Examiner*—John A. Jeffery
(74) *Attorney, Agent, or Firm*—Wall Marjama & Bilinski LLP

(57) ABSTRACT

A hair processing accelerator which can uniformly irradiate heat to a hairline of the whole circumference of hair includes first and second heater units having first and second heaters of a generally semicircular shape connected to a top portion of a head top unit supporting part 3 which is positioned in the head top of hair. While moving through multiple positions and by swinging and rotating around hair so as to separate from each other to right and left or approach each other from right and left by a heater unit driving part 50 contained in a body supporting part 5, the first and second heater units irradiate heat to all the areas of hair from the head top of hair to each of right and left sides.

8 Claims, 7 Drawing Sheets

HAIR PROCESSING ACCELERATOR WITH ROTATABLY ADJUSTABLE SEMICIRCULAR HEATERS

FIELD OF THE INVENTION

The present invention relates to a hair processing accelerator which irradiates heat to hair, thereby to accelerate the procedures of hair perm, hair dyeing, hair drying, and the like, when the procedures are performed at a barbershop or a beauty salon.

BACKGROUND OF THE INVENTION

Conventionally, when the hairdressing procedures of hair perm, hair dyeing, and hair drying are performed at a barbershop or a beauty salon, heat is irradiated to hair by a heater or the like, to accelerate the procedures. As a device for irradiating heat to hair, there are a hair processing accelerator described in Japanese Published Patent Application (Examined) No. Hei. 4-644, in which a ring-shaped heater irradiates heat with rotating around a head part, to warm hair, and a hair processing acceleration control device described in Japanese Published Patent Application (Examined) No. Hei. 7-32729, in which plural separated heaters for irradiating heat to respective parts of both sides, a rear part, and a top portion of a head part, to warm hair.

However, when the procedures of hair perm or hair dyeing are performed to hair, heat needs to be irradiated to a hairline in order to accelerate the procedures. In this point, according to the conventional hair processing accelerator described in Japanese Published Patent Application (Examined) No. Hei. 4-644, in which a ring-shaped heater performs an eccentric rotational movement at a shaft as its center, to warm hair with rotating around a head part, the balance of heat distribution between the hairline which especially requires heat and a head top which requires less heat is wrong, thereby easily causing an unevenness or the like of hair perm and hair dyeing. Further, also according to the hair processing acceleration control device described in Japanese Published Patent Application (Examined) No. Hei. 7-32729, the heaters positioned at the head top, both sides, and a rear part of the head part have the wrong balance of heat distribution between the hairline which especially requires heat and a head top which requires less heat, thereby easily causing an unevenness or the like of hair perm and hair dyeing.

SUMMARY OF THE INVENTION

The present invention is made to solve the above-mentioned problems, and it is an object of the present invention to provide a hair processing accelerator which can irradiate more heat to a hairline than to the head top of hair.

In order to solve the problems, according to a first aspect of the present invention, a hair processing accelerator comprises: a head top unit supporting part of a generally semicircular shape which part is fixed to a body supporting part and positioned in the head top of hair; first and second heater units having first and second heaters of a generally semicircular shape, each of both ends of which is fixed rotatably to respective top portions of the head top unit supporting part, for irradiating heat to all the areas from the head top of hair to the respective right and left sides; a unit driving part which rotates and drives the first and second heater units in a direction opposite to each other; a maximum limit switch which detects a maximum position of the rotatable driving range of the first and second heater units; and a minimum limit switch which detects a minimum position of the rotatable driving range of the first and second heater units, wherein the first and second heater units are rotatable between the maximum position and the minimum position.

Therefore, it is possible to irradiate heat to hair of a person to be washed by making the first and second heater units swing and rotate about the head top unit supporting part so as to separate from each other to right and left or approach each other from right and left.

According to a second aspect of the present invention, the hair processing accelerator described in the first aspect, wherein the hair processing accelerator's body is inserted to a top portion of a stand via a supporting rod connected to the hair processing accelerator's body, to be movable on a floor face with the stand Therefore, it is possible to place the present hair processing accelerator at an arbitrary place.

According to a third aspect of the present invention, the hair processing accelerator described in the second aspect, wherein the hair processing accelerator's body can be tilted backward and forward to the supporting rod at a supporting shaft as its center, and rotation of the supporting shaft is locked, thereby to fix the backward and forward tilted position of the hair processing accelerator's body.

Therefore, it is possible to tilt the present hair processing accelerator's body backward and forward in accordance with a head position of the person to be washed.

According to a fourth aspect of the present invention, the hair processing accelerator described in first to third aspects, wherein the maximum position is positioned on a face where the first and second heater units are parallel to each other as well as in a state where the first and second heater units are positioned on the plane parallel to a face where the head top unit supporting unit is positioned, and the minimum position is in a state where the first and second heater units are positioned on the same plane and form a generally circular shape.

Therefore, it is possible to irradiate heat to a hairline on the whole circumference of hair of the person to be washed.

According to the hair processing accelerator according to a fifth aspect of the present invention, the hair processing accelerator described in the fourth aspect, wherein the first and second heater units repeat operations of rotating from the maximum position to the minimum position, rotating from the minimum position to a predetermined oblique position between the maximum position and the minimum position, thereafter, reversing in the oblique position to rotate to the minimum position again, and further rotating from the minimum position to the maximum position.

Therefore, it is possible to irradiate more heat to a hairline which requires heat than to the head top which requires less heat.

According to the hair processing accelerator according to a sixth aspect of the present invention, the hair processing accelerator described in the fifth aspect, wherein the oblique position is set by controlling the elapsed time when the first and second heater units rotate from the minimum position to the maximum position.

Therefore, it is possible to set the position where the first and second heater units are reversed to a desired position.

According to the hair processing accelerator according to a seventh aspect of the present invention, the hair processing accelerator described in the fourth aspect, wherein the first and second heater units repeat operations of rotating from the maximum position to the minimum position, rotating from the minimum position to a predetermined oblique position between the maximum position and the minimum position, and further rotating from the oblique position to the maximum position after stopping in the oblique position for a predetermined period.

Therefore, it is possible to irradiate more heat to a hairline which requires heat than to the head top which requires less heat.

According to the hair processing accelerator according to a eighth aspect of the present invention, the hair processing accelerator described in the seventh aspect, wherein the oblique position is set by controlling the elapsed time when the first and second heater units rotate from the minimum position to the maximum position.

Therefore, it is possible to set a position where the first and second heater units are temporarily stopped to a desired position.

DETAILED DESCRIPTION OF THE PREFERRED EMBODIMENTS

Embodiment 1.

Hereinafter, a hair processing accelerator according to a first embodiment will be described with referring to FIGS. 1 to 8.

Initially, a structure of the hair processing accelerator according to the first embodiment will be described with referring to FIG. 1.

Figure 1:
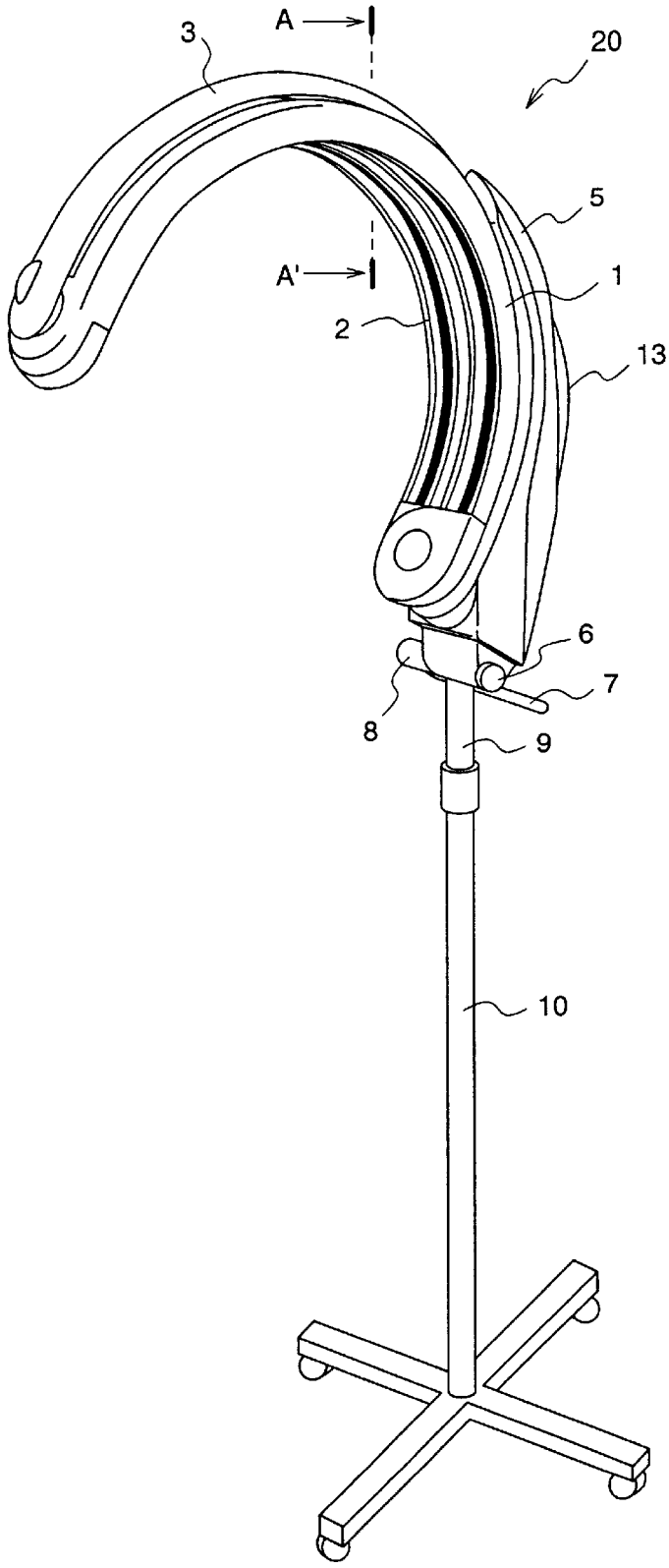
FIG. 1 is a front perspective view illustrating a hair processing accelerator according to a first embodiment of the present invention.

FIG. 1 is a front perspective view illustrating a hair processing accelerator according to the first embodiment of the present invention.

In FIG. 1, the hair processing accelerator according to the first embodiment has a hairdressing processing part 20 comprising first and second heater units 1 and 2 for irradiating heat to all the areas of hair from the head top to both right and left sides of hair while swinging and rotating around hair, so as to separate from each other toward right and left or approach each other from right and left, by a heater unit driving part 50 (not shown) contained in a body supporting part 5. The hairdressing processing part 20 is inserted to a top portion of a stand 10 via a supporting rod 9, to be placed at an arbitrary place on a floor face.

The hairdressing processing part 20 can be tilted backward and forward to the supporting rod 9 at a supporting shaft 6 as its center. A handle 7 fixed to a supporting shaft lock bracket 8 is lifted up, to lock rotation of the supporting shaft 6, thereby fixing the backward and forward tilted position of the hairdressing processing part 20.

Hereinafter, respective parts of the hairdressing processing part 20 will be described in detail with referring to FIGS. 2 to 5.

Initially, the structure of the first and second heater units 1 and 2, and connected portions between both of the heater units 1 and 2 and a head top unit supporting part 3 located on the head top of hair will be described with referring to FIGS. 2 and 3.

Figure 2:
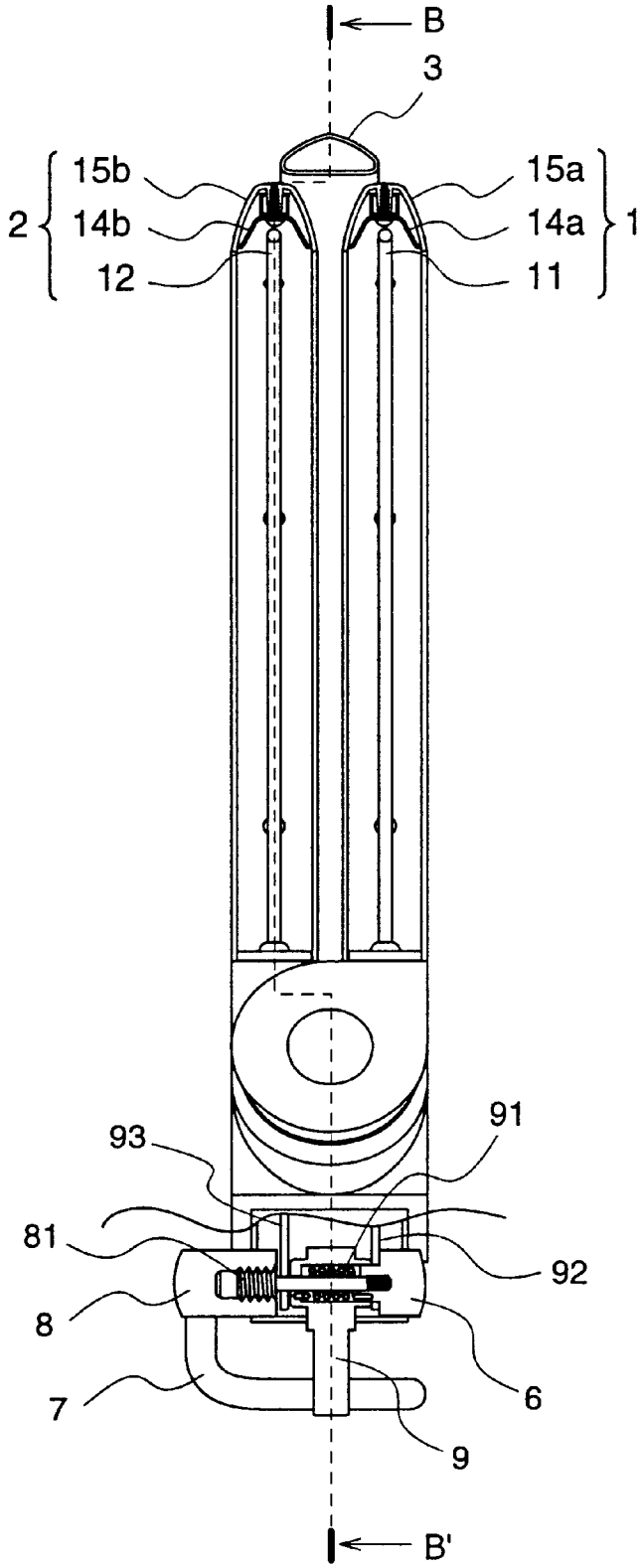
FIG. 2 is a cross sectional view on line A–A' illustrating a hair processing accelerator in FIG. 1.

FIG. 2 is a cross sectional view on line A–A' of the hairdressing processing part in FIG. 1. FIG. 3 is a cross sectional view on line B–B' of the hairdressing processing part in FIG. 2.

Figure 3:
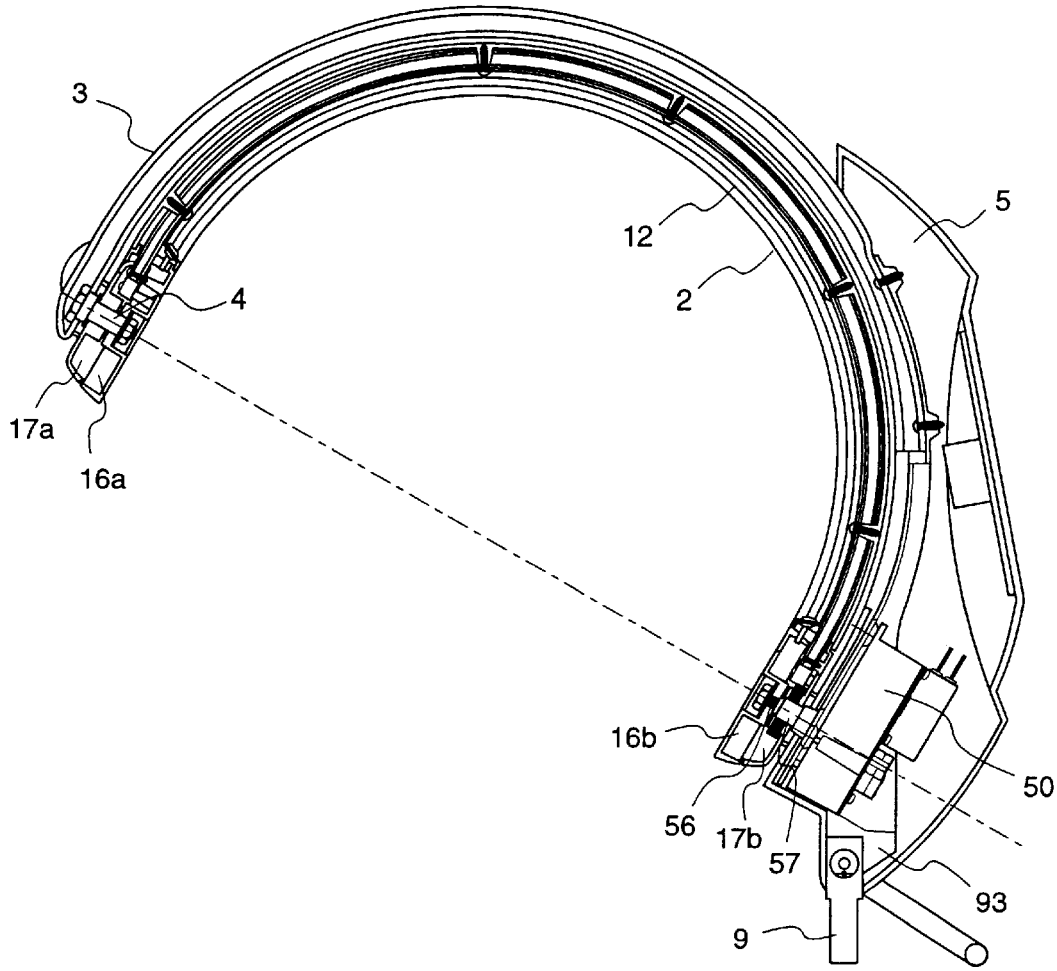
FIG. 3 is a cross sectional view on line B–B' illustrating a hair processing accelerator in FIG. 2.

In FIG. 2, the first and second heater units 1 and 2 comprises a heater for irradiating heat to hair, a reflecting plate 14 for enabling to conduct heat of the heater over wider area, a heater cover 15 to be a frame of the heater and the reflecting plate, and first and second rotatable brackets 16 and 17 provided on both top portions of the first and second heater units 1 and 2, the respective heater units which are connected to the head top supporting part 3 by rotatable shafts 4 and first and second motor output shafts 56 and 57 of a heater unit driving part 50 on portions of the first and second rotatable bracket 16 and 17 as shown in FIG. 3.

Figure 4A:
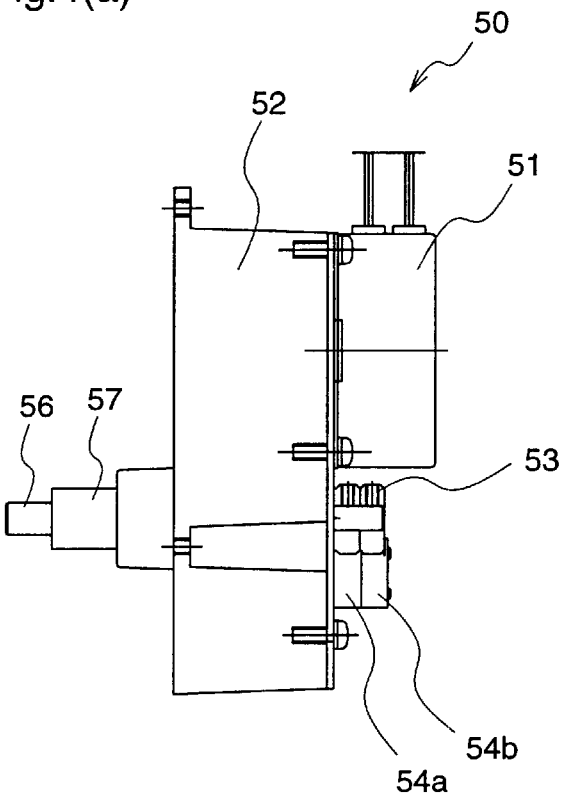
FIG. 4 are views illustrating a heater unit driving part of a hair processing accelerator according to the first embodiment of the present invention.
Figure 4B:
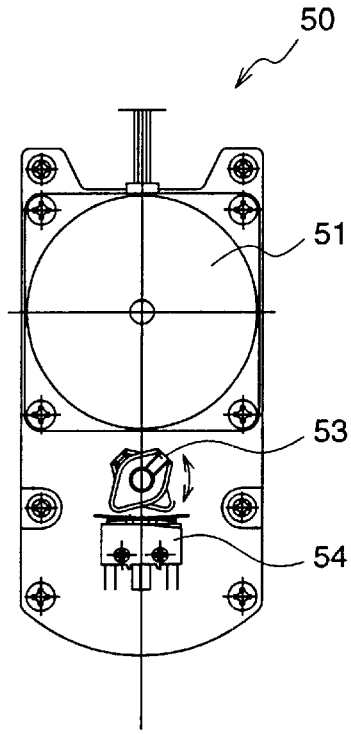
Figure 5:
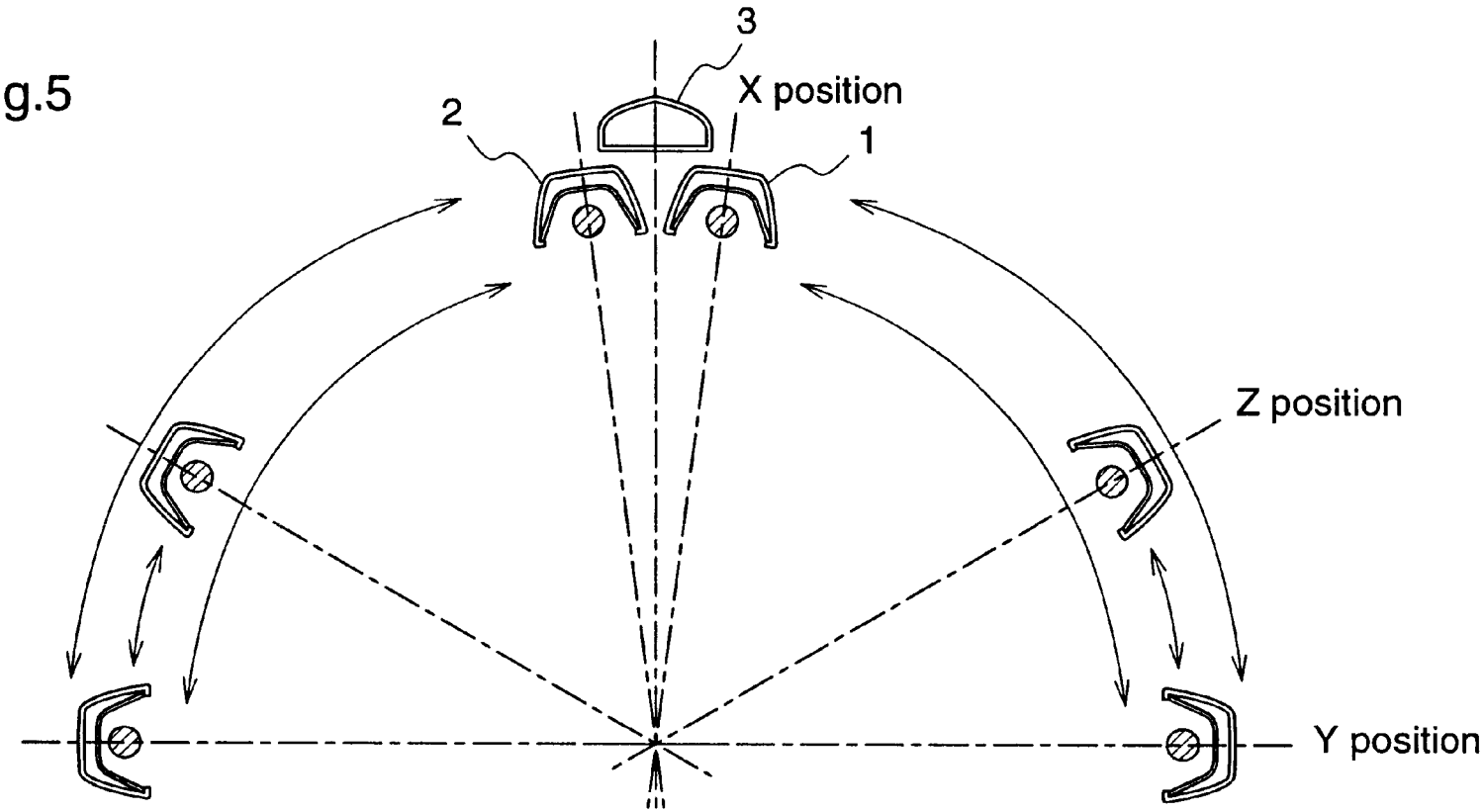
FIG. 5 is a view illustrating a rotatable range of first and second heater units of a hair processing accelerator according to the first embodiment of the present invention.

Next, the heater unit driving part 50 will be described with referring to FIGS. 4 and 5. FIG. 4(*a*) is a cross sectional view of the heater unit driving part 50 according to the first embodiment, FIG. 4(*b*) is a front view of the heater unit driving part 50, and FIG. 5 is a view illustrating a rotatable range in a case where the first and second heater units swing and rotate around hair according to the first embodiment.

In FIG. 4, the heater unit driving part 50 comprises a motor 51, a motor-gear box 52, a driving cam 53, maximum and minimum limit switches 54*a* and 54*b*, and the first and second motor output shafts 56 and 57, which driving part rotates the first and second heater units 1 and 2 so as to separate from each other toward right and left around hair or approach each other from right and left.

The first and second motor output shafts 56 and 57 are connected to each other by a gear so as to rotate in a direction opposite to each other, rotate in a direction opposite to each other by a drive of the motor 51, and are connected to the first and second rotatable brackets 16*b* and 17*b*, respectively, so as to transmit the driving output from the motor 51 to the first and second heater units 1 and 2 and make both of the heater units 1 and 2 respectively swing and rotate around hair from side to side as described above.

The driving cam 53 is fixed on the other end of a shaft linked with the motor output shaft 55 and swings and rotates together with the first and second heater units 1 and 2.

The maximum and minimum limit switches 54*a* and 54*b* is pushed by a projecting portion of the driving cam 53, thereby detecting maximum and minimum positions of the first and second heater units and determining a rotatable range of both of the heater units 1 and 2. In this embodiment, a range from a state where the first and second heater units 1 and 2 are parallel to each other and positioned on a plane parallel to a face on which the head top unit supporting part 3 is positioned as an X position shown in FIG. 5 to a state where both of the heater units 1 and 2 form a generally circular shape on the same plane as a Y position is taken as the rotatable range, and both of the heater units 1 and 2 reverse the rotating direction in a predetermined Z position between the X position and the Y position and move as X position-Y position-Z position-Y position-X position, thereby swinging around hair. In this way, in addition to reciprocating rotation between the X position and the Y position, both of the heater units 1 and 2 further rotate between the Z position and the Y position, thereby irradiating more heat to a hairline which requires heat than to the head top of hair which requires less heat. Further, the predetermined Z position can be set by controlling the elapsed time when the heater units 1 and 2 moves from the Y position to the X position.

Here, a rotational operation of the first and second heater units 1 and 2 will be described in detail with referring to FIG. 5. Initially, the first and second heater units 1 and 2 are in the X position, and rotate from the X position to the Y position so as to separate from each other to right and left. When the Y position is detected by the minimum limit switch 54*b*, both of the heater units 1 and 2 rotate from the Y position to the X position so as to approach each other from right and left next time. When the previously set time has elapsed since rotation of both of the heater units 1 and 2 from the Y position to the X position is started, a reverse output is outputted by the heater unit driving part 50, and both of the heater units 1 and 2 reverse in the Z position which is a point when the set time has elapsed and rotate from the Z position to the Y position again so as to separate from each other to right and left. When the Y position is detected by the minimum limit switch 54*b* again, both of the heater units 1 and 2 rotate from the Y position until the X position is detected by the maximum limit switch 54*a*, so as to approach each other from right and left.

Next, a connecting portion of the hairdressing processing part 20 and the supporting rod 9 will be described with referring to FIG. 2. In FIG. 2, a chassis 92 at a supporting shaft 6 side of chassises 92 and 93 of the present hairdressing processing part 20 and a supporting shaft lock bolt 81 are fixed to the supporting shaft 6. A handle 7 is fixed to a supporting shaft lock bracket 8, with which the supporting shaft lock bolt 81 is engaged at an approximate rigidity. A supporting rod 9 is provided with a spring 91 therein, one end of which spring 91 is fixed to the supporting rod 9, and the other end of which is fixed to the supporting shaft 6. This spring 91 pushes outside the supporting shaft 6, to which the chassis 92 is fixed, by resiliency of the spring, thereby to pull near the supporting rod lock bolt 81 fixed to the supporting shaft 6 toward the chassis 93. Therefore, the supporting rod 9 is pressed, thereby to prevent the hairdressing processing part 20 from falling forward. Further, when a position of the hairdressing processing part 20 is desired to be locked, the handle 7 is lifted up. Thereby, the supporting shaft lock bracket 8 is more tightly engaged with the supporting shaft lock bolt 81. Therefore, the supporting shaft lock bracket 8 and the supporting shaft 6, respectively, are pressed toward the side of the chassises 92 and 93, thereby to lock the position of the hairdressing processing part 20 by the frictional force between the supporting shaft 6 and the chassis 92 and the frictional force between the supporting shaft lock bracket 8 and the chassis 93, so as not to move.

Further, an operation panel 50 of the hair processing accelerator, which is provided with switches by which operations of the hair processing accelerator, such as the power of the present hair processing accelerator, a setting of temperatures of the first and second heaters 11 and 12 of the first and second heater units 1 and 2 and heat irradiating period by the heaters, a setting of an arbitrary position where the first and second heater units reverse, and a start of heat irradiation, are performed, is attached to a body supporting part 5.

Figure 6B:
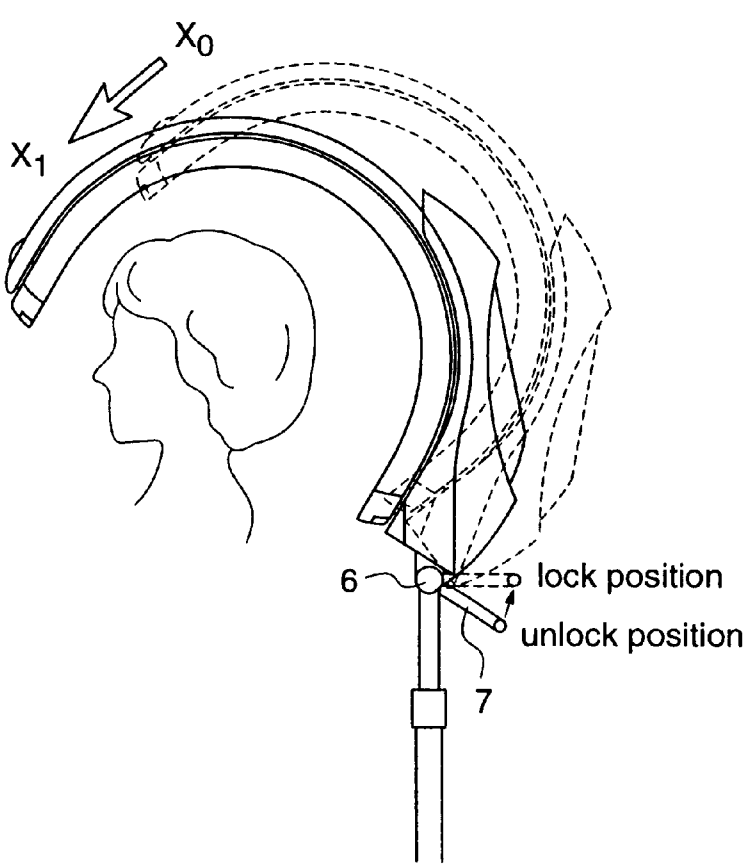
FIG. 6 are side views of a hair processing accelerator according to the first embodiment, at the timing when the positions of the heater units are adjusted.
Figure 6A:
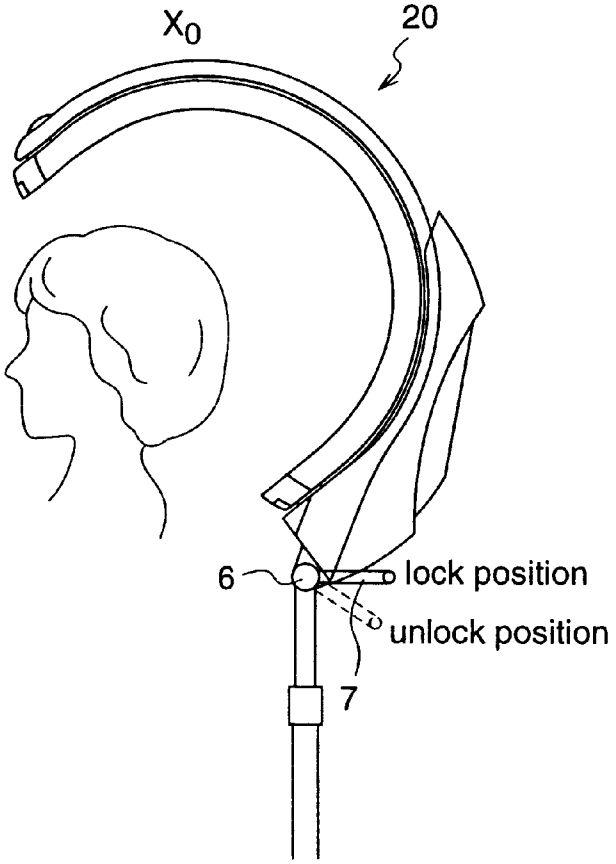
Figure 7:
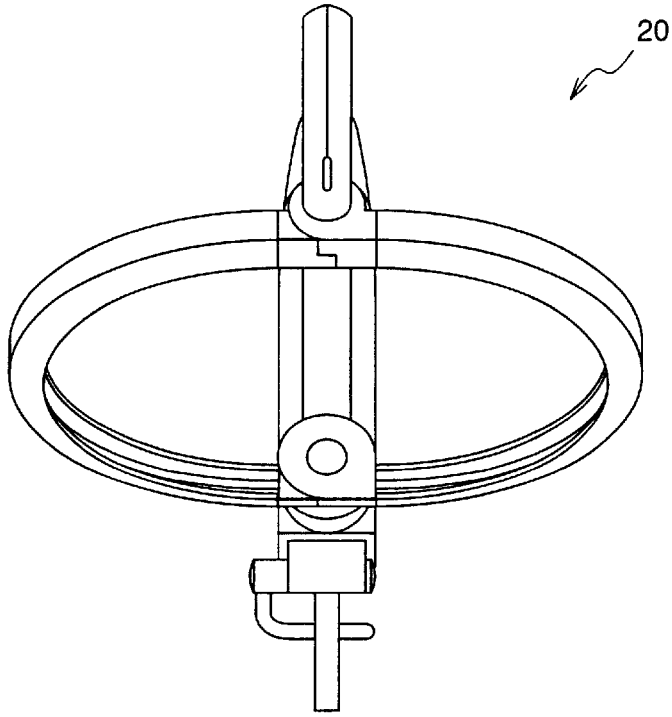
FIG. 7 is a view when the first and second heater units of a hair processing accelerator according to the first embodiment of the present invention are in the minimum position.
Figure 8:
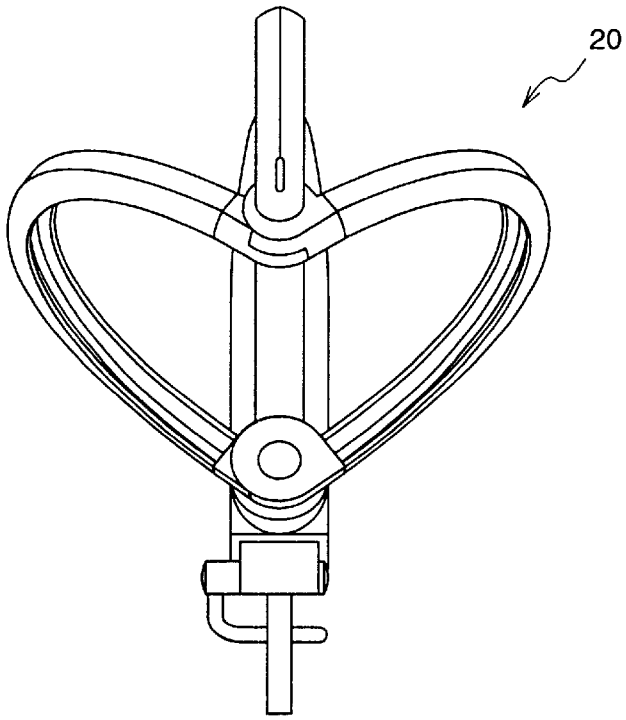
FIG. 8 is a view when the first and second heater units of a hair processing accelerator according to the first embodiment of the present invention are in a reverse position.

Next, operations of irradiating heat to hair of the person to be washed with employing the hair processing accelerator according to the first embodiment will be described with referring to FIGS. 6 to 8. FIG. 6(*a*) is a side view according to the first embodiment, before a position of the hairdressing processing part 20 is adjusted. FIG. 6(*b*) is a side view according to the first embodiment, at the timing when the position of the hairdressing processing part 20 is adjusted. FIG. 7 is a front view illustrating the hairdressing processing part at the timing when the first and second heater units of the hair processing accelerator according to the first embodiment are in the Y position in FIG. 5. FIG. 8 is a front view illustrating the hairdressing processing part at the timing when the first and second heater units of the hair processing accelerator according to the first embodiment are in the Z position in FIG. 5.

Initially, a hairdresser (not shown) places the hair processing accelerator behind the person to be washed who is seated on a barber or beauty chair with the hairdressing processing part 20 being positioned at an up position keeping position $X_0$ shown in FIG. 6(*a*).

Then, the hairdresser tilts the hairdressing processing part 20 positioned at the up position keeping position $X_0$ in FIG. 6(*a*) to a desired position $X_1$ shown by a solid line in FIG. 6(*b*).

Here, the tilting movements concerning the supporting rod 9 of the hairdressing processing part 20 will be concretely described. When the hairdressing processing part 20 is moved from the position $X_0$ in FIG. 6(*a*) to the position $X_1$ shown by a solid line in FIG. 6(*b*), initially, the hairdresser (not shown) lowers down the handle 7 from a lock position to an unlock position in FIG. 6(*a*), thereby to open the lock of the hairdressing processing part 20. Next, the hairdresser gradually tilts the hairdressing processing part 20 forward from the position $X_0$ shown by a dotted line in FIG. 6(*b*), until the hairdressing processing part 20 reaches the position $X_1$ shown by the solid line in FIG. 6(*b*), in which position the heater units 1 and 2 of the hairdressing processing part 20 can sufficiently irradiate heat to hair of the person to be washed. Then, the hairdresser lifts the handle 7 to the lock position, to lock the tilted position of the hairdressing processing part 20.

As described above, after the position of the hairdressing processing part 20 is adjusted to the person to be washed, the hairdresser turns on electricity of the hair processing accelerator, and pushes the power switch on the operation panel 13, to turn on the power of the hair processing accelerator.

The hairdresser operates the switches on the operation panel 13 to set a temperature of the heaters and the heat irradiating period which are suitable for a procedure menu among hair perm, hair dyeing, and a hair treatment, which the person to be washed will receive, and thereafter pushes a switch for starting heat irradiation to start irradiating heat to hair of the person to be washed.

At the same time when the hairdressing processing part 20 starts the heat irradiation to hair of the person to be washed, the first and second heater units 1 and 2 start swinging and rotating around hair of the person to be washed. The first and second heater units rotate as the X position-the Y position-the Z position-the Y position-the X position as described above. Here, when the hairdresser considers that the previously set reverse position is a little low for hair of the person to be washed at the present point of time so that heat is not sufficiently irradiated to the hairline, the elapsed time that it takes to move from the Y position to the Z position is set again by the operation panel 13 to be longer, thereby to make the Z position higher than that at the present point of time.

When the heat irradiating period set by the operation panel 13 from the heaters has elapsed, the heaters 11 and 12 are automatically turned out, and the heat irradiation to the hair of the person to be washed is completed. Following this, the first and second heater units 1 and 2 automatically return to a state shown in FIG. 1. The hairdresser turns out the power of the operation panel 13 and moves the hair processing accelerator from the behind of the person to be washed to another place, wherein the hairdressing procedures for the person to be washed are not obstructed.

As described above, according to the hair processing accelerator of the first embodiment, the first and second heater units 1 and 2 are rotatably connected to the head top unit supporting part 3 positioned on the head top of hair of the person to be washed by the rotatable shafts 4*a* and 4*b*, the heater unit driving part 50 is engaged with the rotatable shaft 4*b*, and the first and second heater units 1 and 2 swing and rotate so as to separate from each other from the head top of hair to right and left or approach each other from right and left. In the rotational operation, the first and second heater units rotate from a maximum position where the first and second heater units are positioned on a plane parallel to each other as well as in a state where both of the heater units are located on a plane parallel to the face on which the head top unit supporting part 3 is positioned to a minimum position where the first and second heater units are positioned on the same plane and form a generally circular shape, and then rotate from the minimum position to a predetermined oblique position. Thereafter, a reverse output is performed in the predetermined oblique position by the heater unit driving part 50, and, after rotating to the minimum position again, the first and second heater units 1 and 2 rotate from the minimum position to the maximum position. Therefore, more heat can be irradiated to the hairline which requires heat than to the head top which requires less heat.

Further, according to the hair processing accelerator of the first embodiment, the reverse position is set by controlling the elapsed time from the minimum position, thereby moving the reverse position in accordance with the head of the person to be washed.

Further, while, in the first embodiment, the first and second heater units rotate to the maximum position after the rotational operations of the first and second heater units 1 and 2 are reversed in the predetermined oblique position so that the first and second heater units rotate to the minimum position again, they may rotate to the maximum position after stopping for a certain period, instead of being reversed in the predetermined oblique position.

What is claimed is:

1. A hair processing accelerator comprising:

a head top unit supporting part of a generally semicircular shape which part is fixed to a body supporting part and positioned in the head top of hair;

first and second heater units having first and second heaters of a generally semicircular shape, each of both ends of which is fixed rotatably to respective top portions of the head top unit supporting part, for irradiating heat to all the areas of hair from the head top of hair to the respective right and left sides;

a unit driving part which rotates and drives the first and second heater units in a direction opposite to each other;

a maximum limit switch which detects a maximum position of the rotatable driving range of the first and second heater units; and a minimum limit switch which detects a minimum position of the rotatable driving range of the first and second heater units, wherein the first and second heater units are rotatable between the maximum position and the minimum position.

2. The hair processing accelerator described in claim 1, wherein the hair processing accelerator's body is inserted to a top portion of a stand via a supporting rod connected to the hair processing accelerator's body, to be movable on a floor face with the stand.

3. The hair processing accelerator described in claim 2, wherein the hair processing accelerator's body can be tilted backward and forward to the supporting rod at a supporting shaft as its center, and rotation of the supporting shaft is locked, thereby to fix the backward and forward tilted position of the hair processing accelerator's body.

4. The hair processing accelerator described in claim 1, wherein the maximum position is positioned on a face where the first and second heater units are parallel to each other as well as in a state where the first and second heater units are positioned on the plane parallel to a face where the head top unit supporting unit is positioned, and the minimum position is in a state where the first and second heater units are positioned on the same plane and form a generally circular shape.

5. The hair processing accelerator described in claim 4, wherein the first and second heater units repeat operations of rotating from the maximum position to the minimum position, rotating from the minimum position to a predetermined oblique position between the maximum position and the minimum position, thereafter, reversing in the oblique position to rotate to the minimum position again, and further rotating from the minimum position to the maximum position.

6. The hair processing accelerator described in claim 5, wherein the oblique position is set by controlling the elapsed time when the first and second heater units rotate from the minimum position to the maximum position.

7. The hair processing accelerator described in claim 4, wherein the first and second heater units repeat operations of rotating from the maximum position to the minimum position, rotating from the minimum position to a predetermined oblique position between the maximum position and the minimum position, and further rotating from the oblique position to the maximum position after stopping in the oblique position for a predetermined period.

8. The hair processing accelerator described in claim 7, wherein the oblique position is set by controlling the elapsed time when the first and second heater units rotate from the minimum position to the maximum position.

* * * * *